United States Patent [19]

Bruns

[11] 4,011,801

[45] Mar. 15, 1977

[54] UNITARY AIR-DIFFUSING WEDGE STRIP IN AIR PROJECTION GRILLE

[75] Inventor: Herbert F. Bruns, Coral Gables, Fla.

[73] Assignee: Bruns Technology, Inc., Coral Gables, Fla.

[22] Filed: May 6, 1975

[21] Appl. No.: 575,146

Related U.S. Application Data

[63] Continuation-in-part of Ser. No. 385,833, Aug. 6, 1973, abandoned.

[52] U.S. Cl. ..... 98/40 D; 98/94 AC

[51] Int. Cl.[2] ..... F24F 13/08

[58] Field of Search ..... 98/40 C, 40 D, 114, 98/94 AC

[56] References Cited

UNITED STATES PATENTS

| | | | |
|---|---|---|---|
| 2,853,935 | 9/1958 | Crowle et al. | 98/94 |
| 3,320,871 | 5/1967 | Wegman | 98/94 |
| 3,482,506 | 12/1969 | Bruns | 98/40 C |
| 3,736,858 | 6/1973 | Mercier | 98/40 C |

*Primary Examiner*—William E. Wayner
*Attorney, Agent, or Firm*—Oltman and Flynn

[57] ABSTRACT

The present air diffuser has one or more unitary strips of adjoining tetrahedronal wedges which are progressively inclined and leaned laterally to deflect the supply air laterally outward beyond the diffuser for creating a wide, coherent, non-turbulent air blanket. At the outside of the diffuser, the wedge strip presents a series of adjoining triangular front faces which are imperforate to minimize air turbulence there when ambient room air is induced into the supply air stream emerging from the diffuser.

9 Claims, 18 Drawing Figures

UNITARY AIR-DIFFUSING WEDGE STRIP IN AIR PROJECTION GRILLE

CROSS REFERENCE TO RELATED APPLICATION

This application is a continuation-in-part of my copending U.S. patent application Ser. No. 385,833, filed Aug. 6, 1973, now abandoned.

BACKGROUND OF THE INVENTION

In my previous U.S. Pat. Nos. 3,482,506 and 3,877,356, I have disclosed various air projection grilles for use at cooled-air, heated-air or ventilating-air outlets to diffuse the emerging air and induce ambient air into the emerging air so as to form a blanket pattern of air which minimized drafts or air turbulence in the zone which receives it.

SUMMARY OF THE INVENTION

The present invention is directed to a novel and improved air projection grille of simplified design and unitary construction for accomplishing the same purposes as the grilles of my previous patents mentioned above.

In one embodiment my present invention provides a grille for attachment to the air outlet of a wall-mounted room air conditioning unit.

In accordance with the basic concept of the present invention the grille is composed of one or more strips which have a base and a plurality of air-diffusing wedges of tetrahedronal design in succession laterally of the strip on one side of the base. The successive air-diffusing wedges in at least one direction laterally outward from a reference point along the strip are positioned with progressively greater angularity laterally with respect to the upstream air flow and lean progressively toward the base, with the inboard side faces becoming progressively longer and the outboard side faces progressively shorter at the downstream side of the wedge strip in that lateral direction. This progressive angularity lean preferably takes place in opposite lateral directions on opposite-sides of the centerline of the upstream air flow. Alternatively, this lateral angularity and lean may be primarily or substantially completely in one lateral direction, depending upon the location of the air outlet in the room. The emerging air is spread out laterally of the air outlet where the wedge strip is located to provide a broad area, relatively thin blanket of air.

The air-diffusing wedge strip is elongated laterally with respect to the direction of the upstream air flow, presenting several wedges in succession, each having at its air-outlet side a triangular face which preferably is imperforate so as to reduce air turbulence and promote the induction of ambient air into the air stream flowing past the wedges for providing the desired cohesive air blanket which tends to cling to the nearest surface of the room as it spreads.

Further advantageous characteristics of the present invention will be apparent from the following detailed description of several presently-preferred embodiments thereof, which are shown in the accompanying drawings in which.

Figure 1:
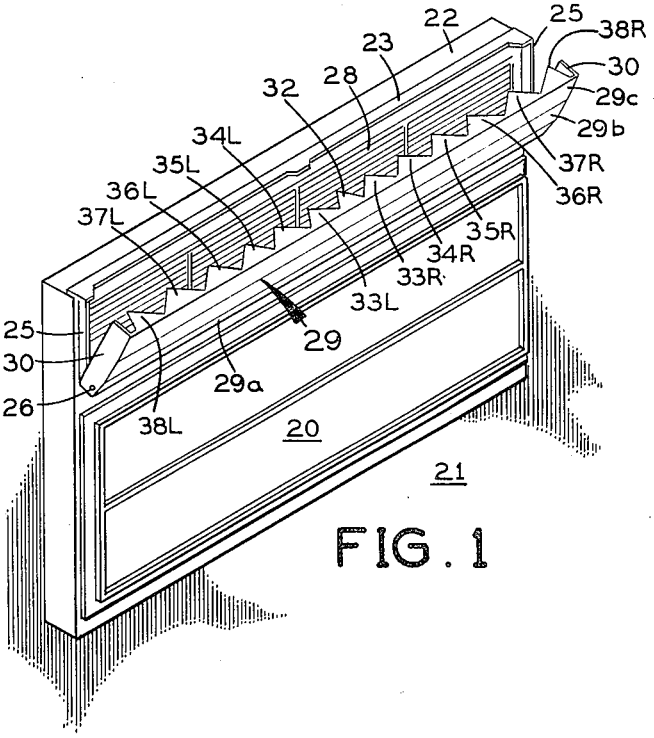
FIG. 1 is a front perspective view showing an air diffusing wedge strip in accordance with the present invention mounted on a wall-mounted room air conditioner at the latter's air outlet.

Referring first to FIG. 1, a room air conditioner unit 20 of known design is shown mounted at one vertical wall 21 of a building. It will be understood that this air conditioner unit may be mounted at an opening in this wall or at a window located on this wall. The front of the air conditioner projects a short distance inward from the wall 21 into the room, as best seen in FIG. 2, and it presents an upwardly facing, horizontal top surface 22 on which the present air diffuser may be mounted.

In this embodiment, the air diffuser has a mounting piece with a snug fit on top of the air conditioner unit 20. This mounting piece includes a top plate 23 which overlies the top surface 22 of the air conditioner unit 20 from end to end and carries an adhesive strip 24 (FIG. 2) on its under side for engagement to the latter. The mounting piece has opposite end legs 25 which extend down from its top plate 23 directly in front of the air conditioner unit 20 at each end. These depending end legs 25 carry respective horizontal pivot pins 26 at their lower ends on which the present air-diffusing wedge strip is mounted at each end. The mounting piece has a horizontal bottom ledge 27 which extends across the front of the air conditioner unit between the lower ends of the respective end legs 25 at a location just below the louvered air discharge outlet 28 at the upper front of the air conditioner unit.

The air-diffusing wedge strip is mounted on a base panel 29 extending from end to end across the front of the louvered air discharge outlet 28 of the air conditioner unit. This base panel 29 is attached to transverse end strips 30 which are pivotally mounted at their lower ends on the respective pins 26 at the outside of the respective end legs 25 on the mounting piece.

Figure 2:
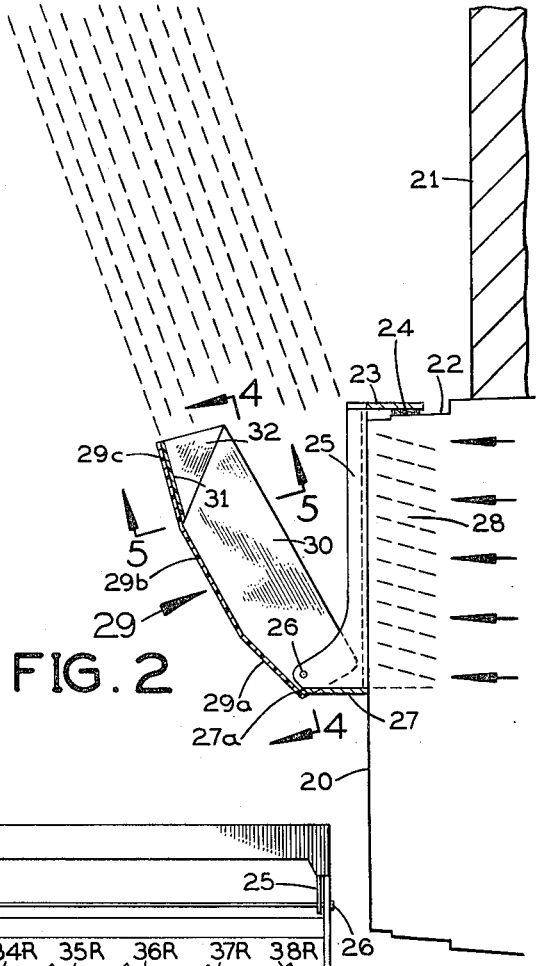
FIG. 2 is a vertical section through this wedge strip on the air conditioner in FIG. 1.

The base panel 29 may be pivoted between a retracted position, not shown, in which it extends more or less vertically up directly in front of the air conditioner outlet 28, and an operative position, shown in FIGS. 1 and 2, in which its upper end is spaced a substantial distance in front of the air outlet 28. As shown in FIG. 2, the base panel 29 for the wedge strip has a flat lower segment 29*a* which abuts against the front edge 27*a* of the bottom ledge 27 on the mounting piece to define the operative position of the wedge strip.

The base panel 29 has a flat middle segment 29*b* extending up from the upper end of its lower segment 29*a* and extending at a slight upward angle to the latter. The base panel 29 has a flat upper segment 29*c* which extends up from the upper end of its middle segment 29*b* at a slight upward angle. With this arrangement, viewed from the air discharge outlet 28 of the air conditioner unit, the base panel 29 presents a concave inner surface which imparts a gradual upward deflection to the supply air emerging from the outlet 28.

Figure 3:
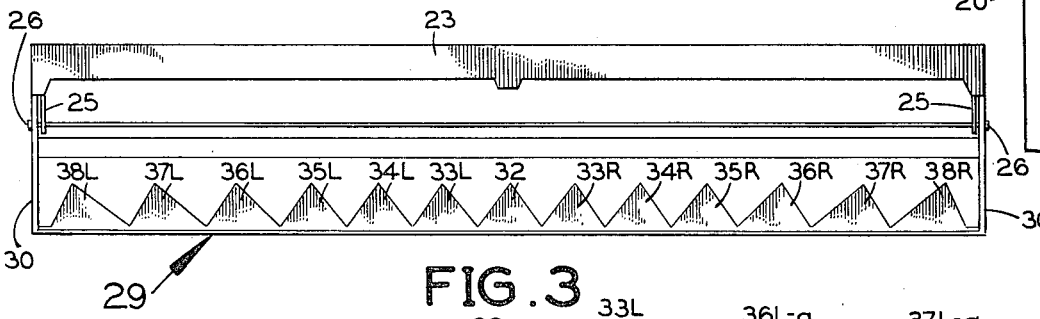
FIG. 3 is a top plan view of this wedge strip.

The wedge strip proper includes a plurality of adjoining tetrahedronal wedges which are connected integrally to a flat base strip 31. The base strip 31 presents successive flat triangular segments between adjoining wedges. The base strip 31 is adhesively secured to the flat inside face of the upper segment 29*c* of the pivoted base panel 29, and the wedges extend in side-by-side succession across the front of the air conditioner outlet 28. In the particular embodiment shown in FIGS. 1–12, there are 13 wedges in the strip, including a central wedge 32, located midway along the strip, and successive pairs of wedges 33L—33R, 34L—34R, 35L—35R, 36L—36R, 37L—37R, and 38L—38R in succession on opposite sides of the central wedge. As shown in FIGS. 1 and 3, the wedges present imperforate triangular front faces which extend substantially perpendicular to the upper segment 26*c* of the base panel 29, flush with the latter's top edge. It should be understood that these front faces of the successive wedges may extend at an acute or obtuse angle to the base panel segment 29*c*, if desired.

Figure 5:
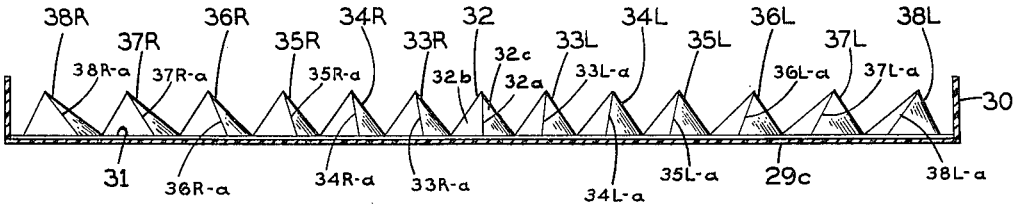
FIG. 5 is a longitudinal sectional view of this wedge strip taken at its air-inlet side along the line 5—5 in FIG. 2.

The apices of all these triangular front faces are substantially equidistantly spaced from the base panel segment 29*c* but they are unequally spaced apart from each other in succession across the front of the air conditioner unit because of the progressive laterally outward inclination and lean of the wedges in each direction away from the central wedge 32. As shown in FIGS. 3 and 5, due to such progressive inclination and lean, at the downstream side of the wedge strip the front edges of the inboard side faces of the wedges are progressively longer and the front edges of their outboard side faces are progressively shorter on each side of the central wedge 32. The triangular front face is one of the four sides of each tetrahedronal wedge.

Figure 4:
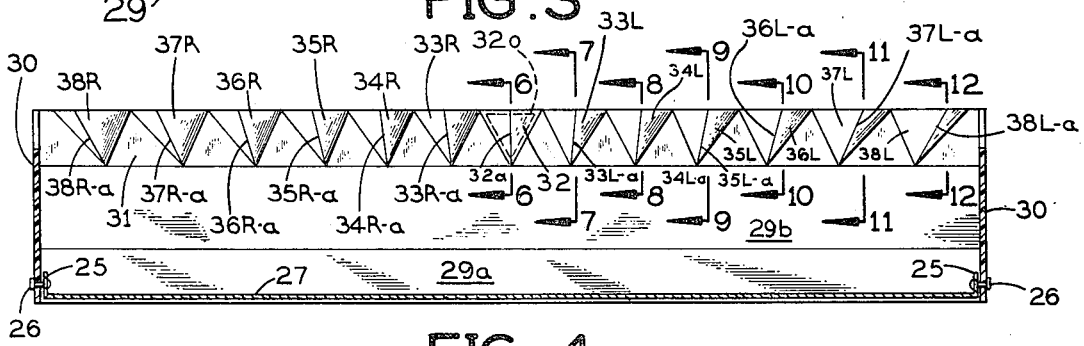
FIG. 4 is a rear elevational view of this wedge strip, taken along the non-vertical line 4—4 in FIG. 2.

The base of each wedge is formed with a draft opening (for molding purposes to enable the walls of the wedge to be equal in thickness). In FIG. 4, only the draft opening 32*o* in the base of the central wedge 32 is shown (in dashed lines). However, it is to be understood that each of the other wedges in the strip has a similar draft opening in its base. Therefore, on each wedge a second (base) side of the tetrahedron is provided by a triangular, flat edge which extends around the draft opening in that wedge and is adhesively secured to the inside face of the upper segment 29*c* of the pivoted base panel 29. This triangular base edge of the wedge is a coplanar extension of the flat bottom face of the base strip 31.

Referring to FIG. 5, looking upward and outward away from the front of the air conditioner unit and toward the wedges, the central wedge 32 presents an apex line 32*a* at the intersection of its two triangular side faces 32*b* and 32*c*. These two triangular side faces provide the two remaining sides of each wedge tetrahedron. The apex 32*a* on the central wedge 32 is directly aligned with the direction of the supply air flow outward from the air conditioner unit.

However, the corresponding apices 33L*a* and 33R*a* on the neighboring wedges 33L and 33R on either side of the central wedge 32 do not extend parallel to the central wedge apex 32*a* but instead they are inclined laterally outward, in opposite directions laterally away from the central wedge, in the direction along the the wedges away from the air conditioner outlet. Consequently, the air flowing out between wedges 32 and 33L is deflected laterally to the left, viewed from the front (to the right, viewed from behind in FIG. 5, or from above in FIG. 4). Also, the air flowing out between wedges 32 and 33R is deflected laterally to the right viewed from the front (to the left in FIGS. 4 and 5).

In each direction along the wedge strip laterally outward from the central wedge 32, the successive wedges 33L, 34L, 35L, 36L, 37L, 38L and 33R, 34R, 35R, 36R, 37R, 38R have respective apices 33L*a*, 34L*a*, 35L*a*, etc. which have progressively increasing lateral inclinations and lean progressively outward away from the central wedge 22. Consequently, the supply air flow past these wedges receives progressively greater laterally outward deflection, to the left and right, respectively, viewed from in front of the wedge strip.

This progressive lateral inclination and lean of the successive wedges along the strip may be visualized from FIGS. 6–12, which are cross-sections taken through the central wedge 32 and successive wedges to the left at the front apex of each wedge.

With this arrangement, the supply air emerging from the air conditioner outlet 28 and flowing over the wedges is deflected laterally outward on either side of this outlet, as well as being deflected upwardly by the base panel 29 and the wedges. Ambient room air near the present diffuser is induced into this supply air stream and combines with it non-turbulently to form a coherent, relatively thin blanket of air. If the air conditioner outlet 28 is near the ceiling, this blanket of air spreads across the ceiling in front of the air conditioner unit and laterally on either side of it in such a manner that occupants of the room tend not to notice the flow of this cooling air but are conscious of its cooling effect because the entire room is cooled very effectively. Under these circumstances, the air circulation in the room is as follows:

Cooled supply air coming out of the air conditioner unit is deflected upward and diffused laterally outward to form a fan-shaped blanket of coherent air flow. Upon reaching the ceiling, this blanket, which is already mostly mixed with ambient room air, spreads across the ceiling in a direction away from the air conditioner outlet. Warmer ambient room air in front of the air conditioner unit is drawn up into this cool blanket of air and a temperature blending of the two is quickly effected. In practice, the air temperature in front of the present diffuser is virtually the ambient room air temperature since ambient room air is being drawn toward the diffuser for blending with the supply air instead of the cold supply air being blown out into the room.

This advantageous temperature blending and non-turbulent induction of ambient air into the supply air also take place if the air conditioner outlet, where the present grille is mounted, is located so far below the ceiling that the upwardly-directed air blanket does not substantially reach the ceiling and spread across it. In such situations, the supply air emerging from the present grille is a thin, coherent, blanket which spreads laterally as it proceeds away from the grille.

In the operation of the present air-diffusing wedge strip, an important factor is the imperforate construction of the front triangular faces of the individual wedges. This minimizes air turbulence in the immediate vicinity of the supply air outlet side of the diffuser, thus providing a more coherent blanket of air flow which contributes significantly to the avoidance of drafts which would be noticeable to the occupants of the room.

Figures 6, 7, 8, 9, 10, 11, 12, 13, 14:
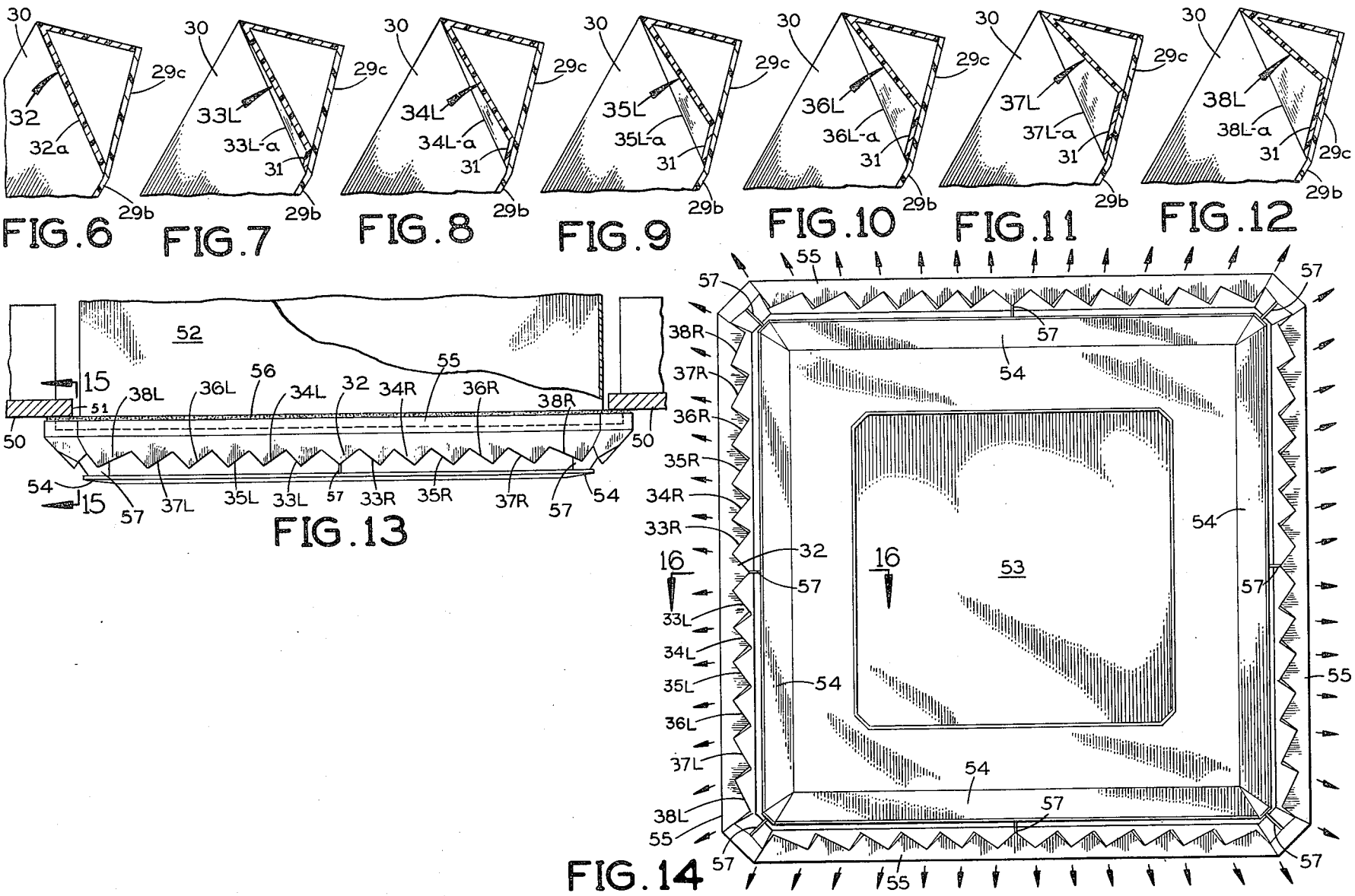
FIGS. 6–12 are transverse sections taken through successive wedges along the wedge strip from the longitudinal midpoint outward toward one end, along the respective section lines 6—6, 7—7, 8—8, 9—9, 10—10, 11—11, and 12—12 in FIG. 4.
FIG. 13 is a vertical and elevational view of a wedge strip air diffuser according to the present invention which is mounted on an air outlet in the ceiling of a room.
FIG. 14 is a bottom plan view of this ceiling-mounted air diffuser.

Referring now to FIGS. 13 and 14, in a second embodiment of the invention illustrated there the air diffuser is attached to an air outlet in the ceiling of a room.

As shown in FIG. 13, the ceiling 50 has an opening 51, and an air duct 52 has its lower end extending down through this opening. The present air diffuser is in the form of a generally rectangular (either square or oblong) structure which extends completely across the lower end of this duct and the ceiling opening 51 and is relatively shallow vertically. It comprises a generally horizontal bottom plate 53 which is inclined upwardly at a slight angle around its entire periphery, as shown at 54 in FIG. 13. The diffuser also has a generally rectangular rigid upper framework 55 having a foam rubber strip 56 on the top for engagement with the ceiling 50 around the latter's opening 51. The bottom plate 53 of the diffuser is attached to this upper framework by thin ribs 57, which are located at the middle of each of the four sides and at each of the four corners, as best seen in FIG. 14.

The diffuser is attached to the lower end of the duct 52 in any suitable manner which causes the foam rubber sealing strip 56 to be pressed against the ceiling 50. In one practical embodiment, the bottom plate 53 of the diffuser is spaced about 1½ to 2 inches below the ceiling.

(The air duct 52 may be provided with a known type of grille or diffuser on its lower end at the ceiling, in which case the present invention may be mounted below the grille or diffuser which is already in place.)

In accordance with this embodiment of the present invention, four air-diffusing wedge strips are integrally connected circumferentially to the upper support framework 55, one wedge strip extending along each side of the framework 55 at a location just laterally outward from the corresponding edge of the bottom plate 53.

As shown in FIG. 14, each wedge strip presents thirteen wedges arranged side-by-side in succession. Each of these four wedge strips is essentially similar in the configuration and positioning of the wedges as the wedge strip already described with reference to FIGS. 1–12. Individual wedges in the four diffuser wedge strips shown in FIGS. 13 and 14 are given the same reference numerals as the corresponding wedges in FIGS. 1–12 and need not be described again in detail. The base of each wedge is at the top and the front apex of the wedge (viewed from outside the diffuser) is at the bottom, spaced a fraction of an inch above the adjacent peripheral lip 54 of the bottom plate 53, as best seen in FIG. 13. As best seen in FIG. 13, the triangular front face of each wedge extends downward and laterally inward at an angle of about 45° with respect to the vertical and terminates in a front apex at its lower end which is spaced laterally outward a fraction of an inch beyond the edge of the peripheral lip 54 on the adjacent side of the bottom plate 53. Accordingly the front apex of each web is located above and laterally outward from the adjacent side edge of the bottom plate 53.

In the operation of this ceiling-mounted air diffuser, the supply air flows vertically down out of the ceiling duct 52, impinges on the bottom plate 53 and is deflected laterally outward in all directions and then passes out along each side of the diffuser between the peripheral lip 54 on the bottom plate 53 and the downwardly projection tetrahedronal wedges along that side. The supply air emerging from the diffuser along all four sides induces ambient room air into the emerging streams, and the net result is the establishment of a coherent, non-turbulent blanket of cooled air that spreads out laterally in all directions across the ceiling. The angular dispositions of the wedges along each side of the diffuser cause the emerging supply air to be diffused laterally outward in both directions at each side for maximum ceiling coverage by the blanket of cooled air.

From the foregoing description it will be evident that the present air projection grille embodies a unitary strip having several tetrahedronal wedges positioned side-by-side across an air outlet for projecting the supply air beyond the air outlet as a relatively thin, coherent blanket, with ambient air being induced into the projected supply air at a low pressure area located at the front of the wedge strip. If desired, two or more such wedge strips may be arranged end-to-end across a single supply air outlet so as to form the complete air projection grille. The height of the wedges in the present air projection grille may be selected in accordance with the size of the room to be served by the grille. In general, the larger the room, the larger should be the height of the wedges so as to project the supply air in a coherent blanket farther out into the room from the air outlet where the present grille is located.

I claim:

1. In an air diffuser to be mounted downstream from a source of pressurized supply air, said diffuser comprising:

a unitary wedge strip having a base and a row of adjoining, tetrahedronal wedges on one side of the base, said row of wedges extending transverse to the supply air flow downstream from said source;

each wedge in the row having opposite, flat, triangular side faces which extend away from the base at opposite acute angles and intersect each other along an apex line which is inclined away from the base in the downstream direction;

and the adjacent side faces of successive wedges in the row at their respective lines of intersection with the base converging toward each other in said downstream direction and intersecting each other at the downstream side of the wedge strip, whereby to provide channels for the supply air flow between successive wedges which at the base narrow to a point and provide V-shaped exit openings for the air at the downstream side of the wedge strip;

the improvement wherein:

the successive wedges along the row in at least one lateral direction outward from a reference point lean progressively toward the base, with the downstream edges of the laterally inboard side faces of successive wedges in said one lateral direction being progressively longer and the downstream edges of the laterally outboard side faces of said wedges being progressively shorter, whereby the confronting side faces of said successive wedges compress and accelerate input supply air which is forced in and flows through the narrowing channels and out of the V-shaped exit openings to form coherent jets which induce surrounding ambient and supply air.

2. An air diffuser according to claim 1, wherein:
the apices of successive wedges at the downstream side of the wedge strip are equally spaced from the base;
and the successive apices at the downstream side of the wedge strip have progressively increasing spacings from each other in said one lateral direction outward from said reference point.

3. An air diffuser according to claim 1, wherein:
said reference point is located substantially midway along said row of wedges;
and the wedges on each side of said reference point lean toward the base.

4. An air diffuser according to claim 1, wherein:
each of said wedges has an imperforate, triangular front face at the downstream side of the wedge strip which extends transversely from the base and intersects said opposite side faces of the respective wedge to form a third face of the wedge tetrahedron having its apex at said apex line between said opposite side faces.

5. An air diffuser according to claim 4, wherein:
said reference point is located substantially midway along said row of wedges;
and the wedges on each side of said reference point lean toward the base.

6. An air diffuser according to claim 5, wherein:
said wedge strip is a one-piece molded plastic body having a hollow interior between said opposite side faces and said front face of each wedge, with a draft opening in each wedge at said base 7. An air diffuser according to claim 1, and further comprising means for mounting said wedge strip in front of the air outlet of a wall-mounted room air conditioner unit, with said apex lines at the intersections between the opposite side faces of the wedges facing toward said air outlet, and with said triangular front faces of the wedges facing outward away from said air outlet.

8. An air diffuser according to claim 7, and means for guiding supply air emerging from the outlet comprising a base panel positioned in front of said outlet and inclined upward and outward away from said outlet, said wedge strip being mounted on the upper end of said base panel on the latter's inside face which faces toward said outlet.

9. An air diffuser according to claim 8 wherein said mounting means comprises a horizontal top plate for overlying engagement with the top of the room air conditioner unit, a pair of opposite end legs extending down from said top plate, and a bottom plate extending horizontally between the lower ends of said end legs, said end legs at their lower ends pivotally supporting said base panel at its lower end for adjustment between a retracted position immediately in front of said air outlet of the room air conditioner unit and an operative position inclined upward and outward away from said outlet.

* * * * *